United States Patent [19]

Doubleday

[11] 3,965,526

[45] June 29, 1976

[54] SUCTION HOSE WITH CONDUCTOR MEANS FOR ELECTRICAL CURRENT

[76] Inventor: Eric G. Doubleday, Am Kraherwald 167, 7 Stuttgart W, Germany

[22] Filed: Nov. 12, 1973

[21] Appl. No.: 414,834

[30] Foreign Application Priority Data

Nov. 16, 1972 Germany ..... 2256231

[52] U.S. Cl. ..... 15/377

[51] Int. Cl.[2] ..... A47L 5/00

[58] Field of Search ..... 15/377, 327 R, 328, 15/331, 335; 174/47; 200/51; 285/7; 287/DIG. 7; 339/15–16, 24, 28, 58, 110 R; 403/326, 344

[56] References Cited

UNITED STATES PATENTS

| | | | |
|---|---|---|---|
| 1,127,022 | 2/1915 | Knight | 287/7 X |
| 1,330,355 | 2/1920 | Spery | 403/344 X |
| 2,526,415 | 10/1950 | Refsdal | 287/136 X |
| 2,528,599 | 11/1950 | Loether | 285/7 X |
| 3,082,289 | 3/1963 | Allen | 174/47 |
| 3,309,113 | 3/1967 | Beach | 285/7 |
| 3,314,039 | 4/1967 | Opper | 285/7 X |
| 3,320,725 | 5/1967 | Foster | 15/327 R X |
| 3,387,319 | 6/1968 | Ferraris et al. | 15/377 X |
| 3,534,317 | 10/1970 | Descarries et al. | 285/7 X |
| 3,553,629 | 1/1971 | Brown et al. | 285/7 X |
| 3,636,285 | 1/1972 | Wickham et al. | 15/377 X |

FOREIGN PATENTS OR APPLICATIONS

| | | | |
|---|---|---|---|
| 1,450,445 | 3/1969 | Germany | 285/7 |

*Primary Examiner*—Peter Feldman
*Assistant Examiner*—Arthur O. Henderson
*Attorney, Agent, or Firm*—Lackenbach, Lilling & Siegel

[57] ABSTRACT

The suction hose interconnecting the vacuum pump of a cleaning machine with the vacuum head is constructed from two concentric flexible tubes. The cable interconnecting the drive motor for the vacuum head with the vacuum pump casing, and thence with the supply network, extends through the space between the aforementioned concentric tubes of the suction hose. Suitable connectors are provided at both ends of the cable to engage with mating connector parts at the vacuum pump and vacuum head of the cleaning machine, respectively.

17 Claims, 11 Drawing Figures

FIG. 4
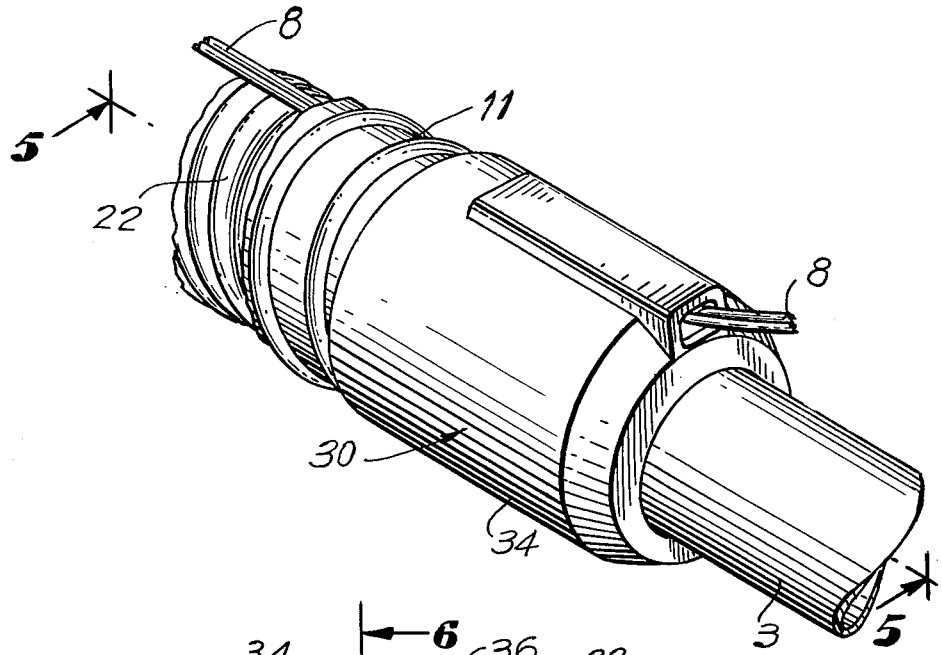
FIG. 5
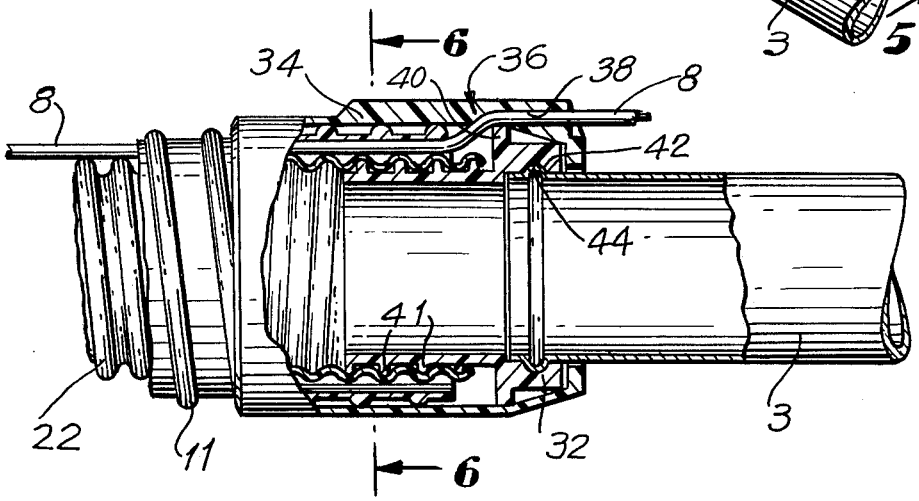
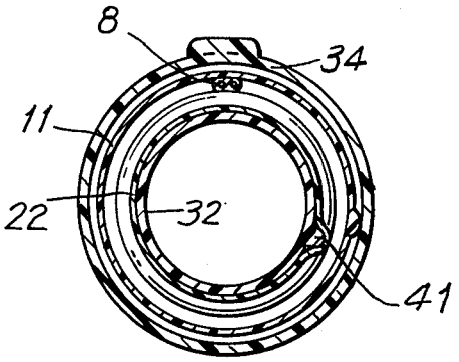
FIG. 6

58
57
56
54
60
62
50
52
8
68
72
9
84
10
86
65
74
70
64
66
88
90
94
89
92
76
78
80
82

SUCTION HOSE WITH CONDUCTOR MEANS FOR ELECTRICAL CURRENT

The instant invention relates to suction hoses used in vacuum cleaners and cleaning machines to interconnect a stationary vacuum chamber with a mobile suction head.

More particularly, the invention relates to suction hoses used in cleaning machines in which the working head incorporates an electrically actuated brush or beater bar to aid in loosening dirt for removal by entraining airstream.

In such devices a requirement exists to provide the required electrical cable to the brush drive in a manner consistent with the desired mobility of the suction head. Many attempts are known in the prior art to integrate such a cable with the suction hose, usually by winding the cable around the external surface of the hose, or by laying it into a helically convoluted surface in the suction hose.

Such devices of the prior art have not been found satisfactory. A cable running alongside the suction hose is subjected to severe operating conditions — it is dragged along on the floor, stepped on, rubbed against walls and furniture as the suction head is moved — which result in damage to the insulation and potentially unsafe conditions for the operator. Where the cable is laid into the surface convolutions normally provided on such hoses, for the sake of improving their flexibility — it tends to stiffen the suction hose and, because the actual length of the cable must be several times the length of the suction hose employed, increases the weight and the cost of the assembly.

Other embodiments of the prior art have provided for the cable to be run in the convolutions of ths hose on the internal surface of the hose and for reinforcing wires, or tubes, to hold the cable in position; such embodiments may protect the cable from abrasive damage but nevertheless suffer the disadvantageous stiffening effect and additional weight, and the further disadvantage of being more complex to assemble with an even greater resulting cost.

It is, therefore, a primary object of the invention to provide a suction hose for cleaning machines having provisions for an electrical cable, and to provide a hose construction which is light in weight, and unimpaired in flexibility — in comparison with suction hoses not incorporating cables — and to provide a hose structure which is easy and economical to manufacture.

SUMMARY

The object of the invention is attained by providing a hose of substantially conventional construction with a liner in the form of a tube slightly smaller in diameter and positioning the cable between the hose and tube. The cable is preferably oval or rectangular in cross-section.

In the preferred embodiment of the invention, described below with reference to the accompanying drawings, the outer hose is provided with a convoluted surface, either as a continuous helix or in the form of bellows, to assure the required flexibility. The inner liner may be similarly convoluted or have a constant diameter. Where both the hose and the liner are convoluted the cable may be pre-crimped into a wavy surface conforming to the shape of the clearance space between them.

The cable is led in a substantially straight line from one end of the hose assembly to the other, thereby reducing the weight and cost of the cable. Proximate the ends of the hose assembly the cable is led through openings in the wall of the outer hose or fittings provided at the ends of the hose assembly. Grommets may be provided to prevent undue wear to the outer insulation of the cable. The free ends of the cable are provided with connectors mating with sockets or plugs attached to the vacuum pump canister at one end and the suction head at the other, permitting the easy interruption of the electrical circuit and disassembly of the suction hose from one or both of the above components.

BRIEF DESCRIPTION OF THE DRAWINGS

The suction hose of the instant invention is illustrated in the accompanying drawings, in which:

FIG. 4 is a partial perspective view of a hose end fitting of the invention;

FIG. 5 is a sectional view taken substantially along lines 5—5 of FIG. 4;

FIG. 6 is a cross-sectional view taken substantially along the lines 6—6 of FIG. 5;

DESCRIPTION OF THE PREFERRED EMBODIMENT

Figure 1:
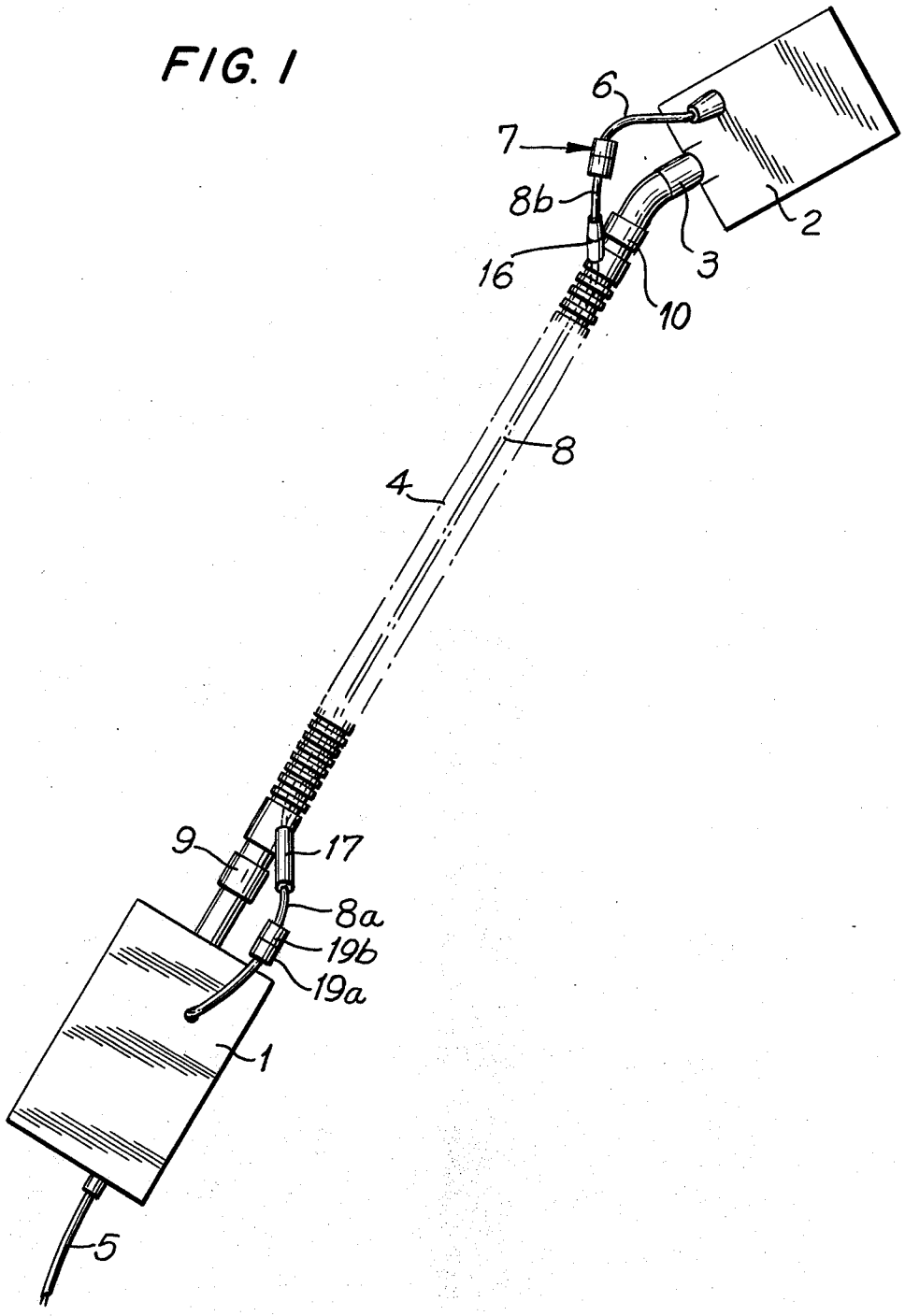
FIG. 1 is a plan view of a cleaning machine equipped with a suction hose of the invention.

FIG. 1 shows a cleaning machine in plan view having a vacuum pump housing, or canister 1 communicating with a vacuum head 2 by means of suction hose assembly 4. The canister 1 contains a vacuum pump with its drive motor, a vacuum chamber, filter bag, controls and other components of a conventional vacuum cleaning device. The vacuum pump motor is connected to the electrical supply network by a cord 5; a supply socket 19*a* is powered from the same source. The hose assembly 4 delivers air with entrained dirt particles into the filter bag of the canister 1 through a fitting 9 mounted on the canister.

The vacuum head 2 incorporates passages through which the air may enter the hose assembly 4, through fitting 10 and one or more brushes, beater bars or similar moving components whose function is to loosen and break up any dirt encountered by the suction head as it is moved over the surface to be cleaned. Such brushes are commonly employed in carpet cleaners and other cleaning machines and greatly improve the efficiency of such devices. The mechanical arrangement of such brushes forms no part of the present disclosure and they are not illustrated in detail, save only that they derive their actuation from one or more electrical motors or magnetic vibrators. The electrical current to supply the aforementioned drive devices for the vacuum head is received at a connector 7 and a cable 6. The supply circuit is completed by a suitable current carrying a wire or cable 8 running through the hose assembly 4 and terminating in connectors 19 (*a* and *b*) and 7 (having male and female elements) at its extremities.

In storage, the canister 1 and the vacuum head 2 are stored independently of the hose assembly 4; there may be several alternative working heads provided for differing tasks in place of the head 2. The machine is assembled to perform a particular task by engaging one end of the hose assembly 4 in the fitting 9 inserting connector 19*b* into its mating half 19*a*, engaging the other end of the hose assembly in fitting 10, and completing the connector 7.

While the electrical connectors 7 and 19 could be incorporated into the fittings 9 and 10, in the embodiment illustrated the ends 8*a* and 8*b* of the cable 8 are led outside the hose assembly through grommets 16 and 17 provided in the exterior wall near the ends of the hose assembly 4.

The tube 3 interconnects fitting 10 with the air passages in the vacuum head 2 and also serves as the handle by means of which the head 2 is moved along the surfaces to be cleaned.

Figure 2:
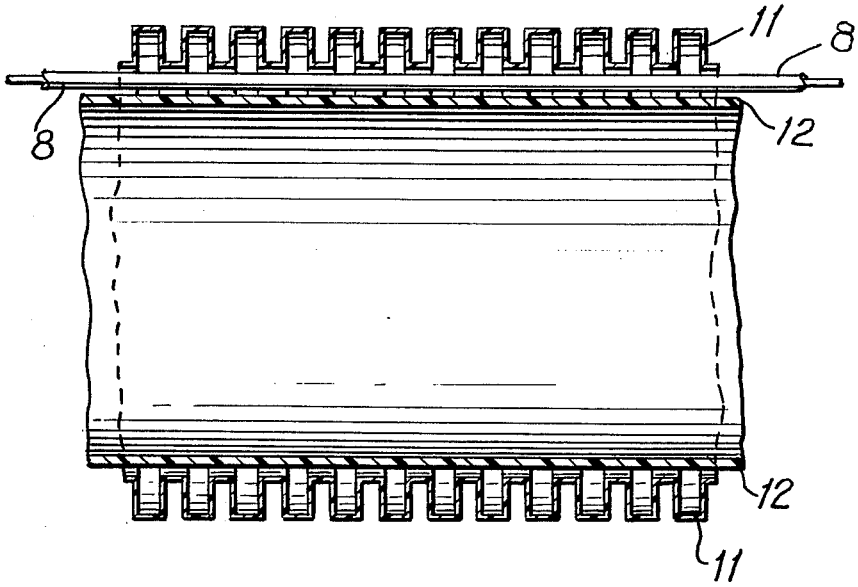
FIG. 2 is a partial longitudinal sectional view of a hose employed in the device of FIG. 1.
Figure 3:
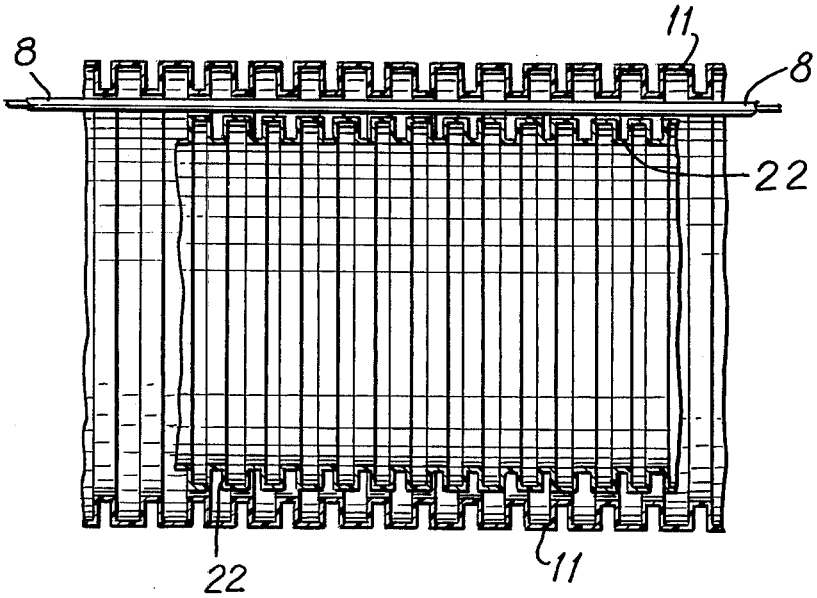
FIG. 3 is a partial sectional view of an alternate embodiment of a hose of this invention, incorporating a convoluted inner liner.

FIG. 2 is a partial longitudinal section through the suction hose 4 in which the convoluted external tube 11, the uniform inner tube 12 and the cable 8 are clearly shown. The external tube 11 is molded with a bellows-like structure from a plastic material to provide for the requirement of flexibility in bending and is advantageously air-tight as shown in FIGS. 2 and 3. The inner tube 12 also advantageously air-tight, is slightly smaller in diameter than the minor diameter of the tube 11, the gap corresponding to the thickness of the cable 8. Because the cable is protected from mechanical damage by the exterior tube 11, even if the latter were to be abraded to the point where it lost a portion of its outermost surface, the insulation required, and hence the cost and weight of the cable, can be reduced to a very thin layer. By utilizing a cable with flattened conductors the gap between tubes 11 and 12 can be reduced even further, so that the increase in overall diameter of the suction hose accommodating the cable can be minimized.

Another embodiment of the invention is illustrated in FIG. 3, where a hose assembly 4 is shown with an external tube 11 and an inner tube 22. The inner tube 22 is made with a convoluted surface to endow the composite structure with greater flexibility. A cable 8 is drawn through the gap between the inner tube 22 and the outer tube 11, with the axis of the cable being substantially parallel to the centerline of the hose assembly 4.

The cable 8 is shown as straight. Were it found to be more convenient it could be preformed into a sinuous shape easily entrapped in the convolutions of the inner and outer tubes.

As shown in FIGS. 4–6, a typical hose end fitting is illustrated in greater detail. Such an end fitting or coupling 30 comprises a two-piece arrangement which dispenses with the need for grommets 16 and 17 as the cable 8 is substantially maintained in position between the co-operatively associated inner restraining surface means of the inner and outer coupling elements 32 and 34, respectively.

Such means comprise the inner wall area or portion 36 adjacent the passageway 38 through which the cable 8 passes, and the outer surface or peripheral edge means of the inner coupling element 32. If desired, the outer surface or peripheral edge means of the inner coupling element 32 may comprise a flange-like element, as best shown in FIG. 5 at 40. However, any suitable means capable of generally wedging and restraining the cable 8 in position between the inner and outer coupling elements 32 and 34 prior to passage of the cable 8 through the opening 38 would be generally acceptable in the operation of the apparatus of the invention. Thus, such a constructional arrangement will positively captivate the cable 8 and preclude it from being pulled or otherwise withdrawn from the hose assembly 4. If desired, a small notch in the flange 40 may be provided for facilitating the passage of the cable 8 therethrough.

Means are also provided on the outer surface of the inner coupling element 32 for securing same to the inner tube 22. In the case of the inner tube 22 comprising a spiral convoluted bellow-like construction, such means as suitable threads 41 or the like are provided for maintaining an essentially air-tight connection between the inner coupling element 32 and the inner tube 22. Of course, in the case of a uniform inner tube 12 as shown in FIG. 2, any suitable means, such as adhesives, clamping means or other like joint or connection elements may be utilized to fixedly secure such members together.

The hose 3 which connects with a suitable vacuum wand is suitably removably retained in place by lip means 42 co-operatively associated with groove means 44 provided about the inner surface area of the inner coupling element 32 opposite to the end portion having the externally disposed threaded means 41.

It will be appreciated that the outer coupling element 34 may be removably disposed about the outer hose 11 and the inner coupling element 32 so as to enable the relatively quick disconnect and easy repairing of the vacuum hose should same or any individual part of the device be damaged. However, it is preferable that the outer coupling element 34 be suitably fastened or locked to the outer hose 11 and/or the inner coupling element 32, such as by means of a cement, glue, weld or other like technique.

In the embodiments of FIGS. 7–11, a vacuum hose 50 is shown between coupling means 52, 54, respectively provided for connection with a vacuum head or wand having a cleaning brush (not shown) and with a typical vacuum canister (not shown). The current carrying cable 56 extends outwardly from a passageway in the coupling means 54 and same is provided with a standard household type of A.C. plug 57 for connection with suitable A.C. power socket means provided in the vacuum canister for delivering current to the cable 56 and ultimately to the powered brush means disposed in the vacuum head or wand.

Tube 58, is suitably connected to the canister by conventional methods for providing the passage means for connection to the suction hose or inner hose 60 disposed within the outer hose 62.

As best shown in FIGS. 8–10 and FIG. 11, which illustrates a smooth or uniform hose, the outer coupling means 52 is provided with a recess 64 which accommodates a lip 66 provided about the end peripheral edge of a tube-like element 68. The tube 68 in turn is suitably connected at its opposite end to a vacuum head by means conventional to those skilled in the art. It is preferrable for the tube's associated mating element 52 to be fabricated of a material which permits easy assembly of such elements, such as a thermoplastic material. Therefore, with such co-operatively associated element made of, for example, a polyethylene plastic, the lip 66 readily snaps into the recess 64. Alternatively, the outer coupling element 52 may be split as at 65 as will be explained in greater detail hereinafter to permit easy assembly of the tube 68 to the coupling element 52, particularly in cases where the tube is made of metal.

Figures 7, 8, 9, 10, 11:
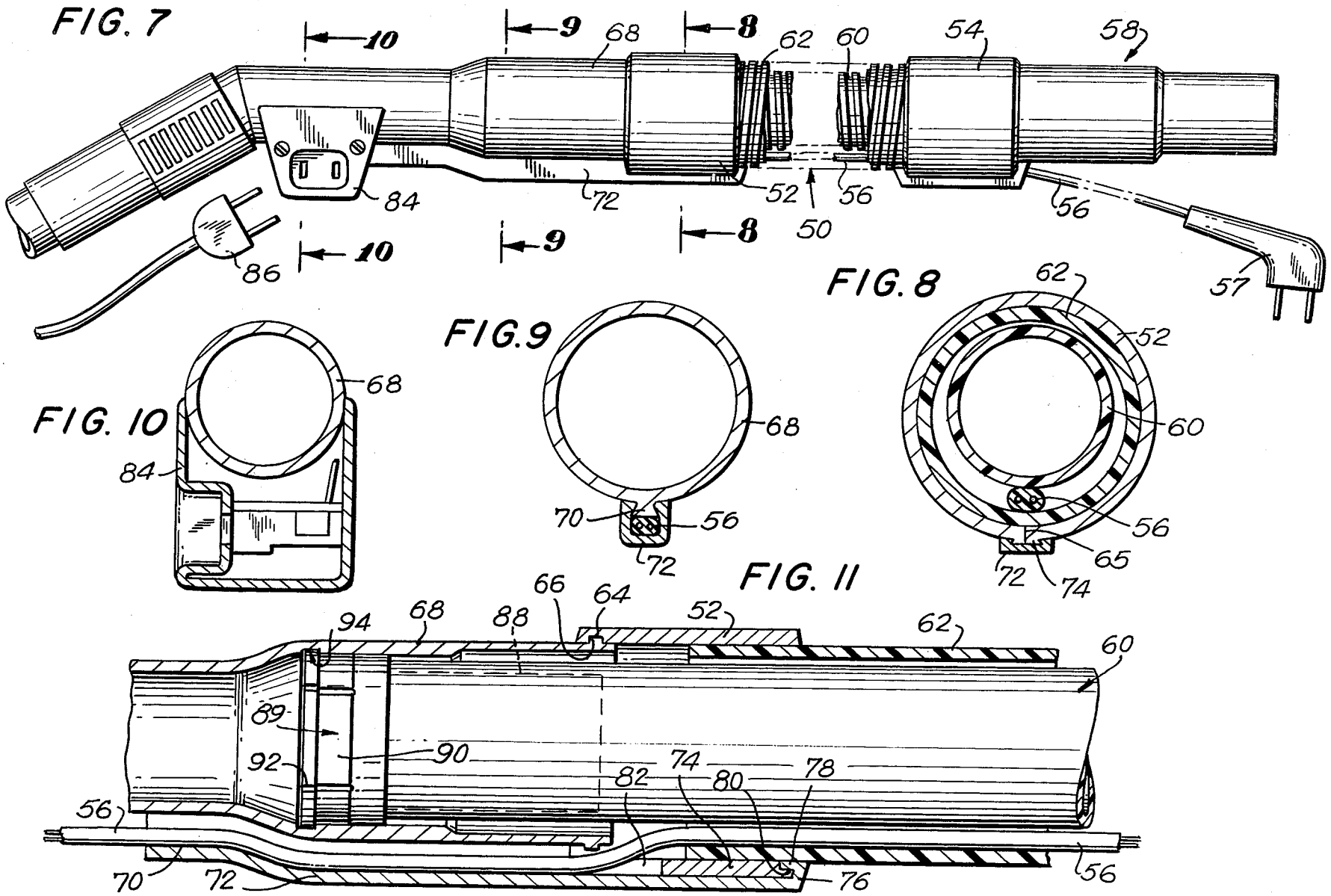
FIG. 7 is a side elevational view, partially broken, showing an alternate embodiment of hose end fittings incorporating the invention.
FIGS. 8, 9 and 10 are sectional views, respectively along the lines 8—8, 9—9 and 10—10 of FIG. 7.
FIG. 11 is a partial sectional view of the coupling structure, of FIGS. 7–9, but modified to illustrate a suction hose comprising uniform inner and outer hose elements.

It will be understood that for purposes of clarity of understanding, the same reference numerals have been employed to identify like parts or elements for both FIGS. 7 and 11 as well as FIGS. 8–10, since the only difference between the two embodiments shown is the representation of a uniform inner and outer hose in FIG. 11, whereas the remaining Figures illustrate bellows hose constructions.

Tube 68 further comprises an integral rib 70, suitably a dovetail section which co-operates with clamping means, preferrably in the form of a U-shaped element 72 adapted to clampingly secure the current carrying cable 56 in its hollow central portion against said rib. In a like manner, the U-shaped element 72 extends beneath the outer coupling element 52 and furthermore clamps the split portion of said element 52 which is also provided with a suitable compatible dovetail section 74 adjacent the split 56, as is best shown in FIG. 8. In addition, at one end 76 of the U-shaped element 72, a small axially extending, flange or lip 78 engages with groove or recess means 80 provided in the outer coupling element 52 so that the element 72 also serves to secure together as an assembly the tube 68 and the outer coupling element 52.

Furthermore, the outer coupling element 52 is notched as at 82 to permit passage of the cable 56 from between the hoses 60, 62 to the hollow central portion of the U-shaped element 72.

At the front or forward end of the tube 68, a suitable A.C. outlet housing 84 is secured and the cable 56 exiting from beneath the U-shaped element 72 is connected electrically to said outlet box or housing 84 in a conventional like manner.

Suitable plug means 86 extending from the vacuum head is thus in turn plugged into such outlet box or housing 84 so as to complete the power circuit from the A.C. plug 57 which is powered suitably from an A.C. outlet socket provided on the canister.

In FIG. 11, an inner coupling element 88 having a head portion 89 is suitably fastened to the inner hose 60. It is preferrably provided with a flanged portion 90, suitably split as at 92, thereby enabling the flange to be elastically deformable and engageable with a co-operating groove 94 provided on the inner wall surface of the tube 68.

It should also be understood that the inner coupling element 32 in the embodiment of FIG. 5 may extend axially outwardly from beneath the outer coupling element 34 in a smooth uniform sleeve like arrangement and in such application, the tube 3 and such axially extending sleeve would be frictionally fitted together with the sleeve of the inner coupling element being disposed about the tube 3. In such construction, there would be no need for the lip 42 and groove or recess 44.

It will be understood that by virtue of the invention, only a straight short length of electric cable is required and consequently the overall hose structure is substantially lighter than other conventional electrical hoses on the market where the cable is made integral with the hose. Note that also with use of flexible inner and outer hoses, they are not readily damaged if one steps on the hose or if any object falls on same.

Because prior art hose constructions are generally heavy and relatively inflexible, there is a high "drag" factor, which particularly on carpets made from artificial fibres results in the hose cover being damaged and ultimately results in short-circuiting damage to the motor and more importantly danger to the user, inasmuch as the voltage employed by the apparatus is sufficient to kill a human being. Thus, in the hose structure of the invention, the outer as well as inner hose wall provides an extra added insulation "safety factor" to the insulated cable itself from both external "drag" wear and from internal abrasive wear.

Although the present invention has been described in some detail by way of illustration and example for purposes of clarity of understanding, it will, of course, be understood that various changes and modifications may be made in the form, details, and arrangement of the parts without departing from the scope of the invention as set forth in the claims.

I claim:

1. A suction hose for a cleaning apparatus provided with an electrically driven vacuum pump and a separate suction head with electrically actuated cleaning brush means, comprising:

a substantially air-tight flexible external tube;

a flexible inner tube, substantially coaxial with said external tube and spaced therefrom;

electrical conductor means interposed between said external and said inner tubes and aligned substantially with the axes of said tubes; and connector means for interconnecting the actuator for said cleaning brush means with the electrical power supply for said vacuum pump drive through said electrical conductor means.

2. The suction hose defined in claim 1, wherein said connector means include grommets passing through the wall of said external tube.

3. The suction hose defined in claim 2, wherein said connector means further include disengageable connectors proximate to said grommets.

4. The suction hose defined in claim 1, wherein said flexible external tube is provided with a convoluted surface.

5. The suction hose defined in claim 4, wherein said flexible inner tube is also provided with a convoluted surface.

6. The suction hose defined in claim 1, further including coupling means, having passage means through a wall surface thereof for accommodating the passage of said electrical conductor means; and said coupling means adapted to connect together said inner and external tubes.

7. The suction hose defined in claim 6, said coupling means comprising inner end fittings secured to opposite open ends of said inner tube and outer end fittings disposed about opposite open ends of said external tube; said inner and outer fittings being substantially coaxially disposed, and said fittings substantially fixedly positioning said electrical conductor means in place in the suction hose apparatus, thereby forming a lightweight and flexible hose assembly with extending conductor means.

8. The suction hose defined in claim 7, wherein said inner end fitting is provided with recess means about its inner wall surface adjacent its open end, and said suction head having a tube with lip means extending therefrom adapted to be removably engageable with the recess means in said inner end fitting.

9. The suction hose defined in claim 6, said coupling means comprising an inner end fitting secured to the opposite open ends of said inner tube and an outer end fitting disposed about opposite open ends of said external tube; at least one of said inner end fittings being removably engageable with respect to a tube forming part of said suction head; said tube being removably engageable with respect to the adjacently disposed outer end fitting; and said fittings substantially fixedly positioning said electrical conductor means in place in the suction hose apparatus, thereby forming a lightweight and flexible hose assembly with extending conducting means.

10. The suction hose defined in claim 9, wherein said outer end fitting comprises a split ring-like fitting having a radially extending rib element forming a dovetail section.

11. The suction hose defined in claim 10, wherein said tube forming part of said suction head includes a substantially elongated, radially extending rib element forming a dovetail section compatible with said dovetail section of said split ring-like fitting.

12. The suction head defined in claim 10, wherein said electrical conductor means being obscured from view upon exiting from said passage means of said outer end fitting by a U-shaped clamp means retained in position about said dovetail section.

13. The suction head defined in claim 12, wherein said outer end fitting adjacent said tube having a notch for the passage of said electrical conductor means from between said inner and external tubes to the hollow central portion of said U-shaped clamp means.

14. The suction head defined in claim 13, wherein the end opposite said notch of said outer end fitting adjacent said tube having recess means, and said U-shaped clamp means having co-operatively associated edge means engageable therewith for locking axially in place said U-shaped clamp means to said outer end fitting.

15. The suction head defined in claim 9, wherein said inner and outer end fittings and the end of said tube are provided with mutually co-operatively associated tongue and groove elements.

16. The suction hose defined in claim 1, wherein said electrical conductor means is in the form of a current-carrying cable which substantially forms a straight line from one end of said tubes to the other end of said tubes.

17. A suction hose for a cleaning apparatus provided with an electrically driven vacuum pump and a separate suction head with electrically actuated cleaning brush means comprising:

a flexible external tube;

a flexible inner tube, substantially coaxial with said external tube and having an outside diameter slightly smaller than the inside diameter of said external tube to form a substantially annular gap between said tubes;

electrical conductor means interposed between said external and internal tubes within said gap and aligned substantially parallel with the axes of said tubes, said gap being dimensioned to receive said electrical conductor means with some clearance;

conductor means for interconnecting the actuator for said cleaning brush means with the electrical power supply for said vacuum pump drive through said electrical conductor means.

* * * * *